US005587218A

United States Patent [19]

Betz

[11] Patent Number: 5,587,218

[45] Date of Patent: Dec. 24, 1996

[54] SURFACE COVERING

[76] Inventor: Richard T. Betz, 701 - 122nd Ave. NE., Bellevue, Wash. 98005

[21] Appl. No.: 245,445

[22] Filed: May 18, 1994

[51] Int. Cl.[6] ..... B44C 1/26

[52] U.S. Cl. ..... 428/67; 15/215; 15/216; 15/217; 52/179; 52/180; 52/181; 52/182; 404/19; 404/21; 404/32; 404/44; 428/95; 428/120; 428/156; 428/167; 428/172; 428/192; 428/908.8

[58] Field of Search ..... 428/67, 156, 167, 428/172, 908.8, 95, 120, 192; 404/19, 21, 44, 32; 52/179–188; 15/215–217

[56] References Cited

U.S. PATENT DOCUMENTS

| | | | |
|---|---|---|---|
| 334,994 | 1/1886 | Spadone | 52/179 |
| 481,702 | 8/1892 | Mason et al. | 52/181 |
| 1,561,668 | 11/1925 | Stanwood | 52/179 |
| 3,353,315 | 11/1967 | Barker | 52/275 |
| 3,565,737 | 2/1971 | Lefevre | 428/67 |
| 4,029,354 | 6/1977 | Valeri | 296/28 D |
| 4,804,570 | 2/1989 | Bedics | 428/53 |
| 4,855,174 | 8/1989 | Kawamoto | 428/67 |
| 4,998,391 | 3/1991 | Connew | 52/179 |
| 5,103,608 | 4/1992 | Andreo | 52/179 |

OTHER PUBLICATIONS

"WP Anti–Slip Safety Stair and Walkway Products by 'Wooster'," Wooster Products, Inc., Wooster, Ohio, 1993 Catalog.

"Pedimat Treadline Pedigrid," Construction Specialties, Inc., Muncy, Pennsylvania, 1992 brochure.

*Primary Examiner*—Nasser Ahmad

*Attorney, Agent, or Firm*—Seed and Berry LLP

[57] ABSTRACT

An improved surface covering includes a base having a plurality of receiving grooves on one side and a plurality of working grooves on the other side. Each receiving groove includes gripping projections and is constructed to receive and grip a filler material. To assemble the surface material, the base material is flexed so that the size of the receiving grooves is enlarged thereby making insertion of the filler material easy. The base material is then returned to its original planar configuration so that the size of the receiving grooves is retracted thereby causing the gripping projection to grip and hold the filler material,

18 Claims, 2 Drawing Sheets

SURFACE COVERING

TECHNICAL FIELD

The present invention is directed toward protective decorative surface coverings and, more particularly, toward such coverings to enhance durability, safety and appearance of flat, sloped, or vertical surfaces.

BACKGROUND OF THE INVENTION

This invention addresses the needs of property owners and managers for surface covering materials to meet the following criteria: they must comply with applicable laws, such as Americans With Disabilities Act (ADA), they must address safety, limit liability, be easily installed and maintained, be pleasing to the eye, and be within the budget with predictable life cycle costs.

For traffic surfaces, a multitude of material options are available, and currently in use. For example, a floor surface may be protected with something as simple as a paint coating, or as sophisticated as a manufactured tread. Other alternatives include specialized carpets, roll-up mats, anti-slip tapes, floor tiles, and rubber or vinyl mats.

For vertical surfaces subject to damage from impact or abuse, multiple products are also available and in use. Examples include specially manufactured panels, bumper guards, crash rails, chair rails, handrails, carpet, corner guards, and special sheet materials. Materials used to create these products include metals, plastics, wood, fiber, etc. Some of the products combine two or more materials.

Prior art surface coverings have limited success in meeting the criteria discussed above. For example, coatings can be difficult to install and maintain. Their decorative appeal, limited to start with, degrades with time and wear. Carpet, while effective in many applications, is not well suited for high abuse traffic areas. This is especially true where the surface is subjected to elements such as the sun, water, chemicals, etc. Some specialty carpets have been developed for such areas, but they have limitations. These include excessive maintenance, stainability, and degradation from exposure to moisture and ultraviolet radiation. Custom designs in carpet are quite costly, and have been found to be lacking in their ability to withstand the abuse to which they are subjected.

Manufactured mats of various designs are available. They include roll-up units with metal or plastic rails, combined with tread surfaces of specially designed materials. Also included are grids, rubber, link, and vinyl mats. The roll-up mats are designed for cleanability, decorative appeal, safety, and ease of maintenance. Properly applied and maintained, they come close to meeting the criteria outlined above. However, they can be less than satisfactory in the following ways: they can warp, causing tripping hazards; they can lose parts of their filler, creating an unsightly safety hazard; they are difficult to manufacture in odd shapes or with custom inserts; and they require almost daily maintenance in high traffic areas.

Anti-slip tapes are used in some applications. They are generally regarded as a low-cost solution to a problem, but they lack visual appeal and fail to provide a long-term answer. Specialty tiles of varied materials are also found in high traffic areas. Each type tends to be made from one material, be it ceramic, rubber, vinyl, stone, etc. The use of tile addresses the decorative aspect, the wearability, and the ease of maintenance. Shortcomings include high cost, the need for skilled tradesmen to install it, possible safety concerns when moisture is present, and breakage under high pressure.

Prior art coverings for vertical surfaces are generally used to limit damage from abuse, while enhancing the appearance. The coverings may be flat or shaped. Flat coverings are designed to limit damage from impact by virtue of their physical properties. The flat materials currently used include wood, carpet, plastic laminate, fiberglass, vinyl acrylic, and special composition sheets. Materials are selected based on appearance, the type of abuse expected, fire codes, flame spread, smoke contribution, out-gassing (sick building syndrome), cost, ease of installation and maintenance, and factors unique to each type of property owner and manager. Flat coverings tend to be manufactured either in large panels or in rolls. Color palates and patterns are limited and subject to change due to trends in the marketplace. For example, plastic laminate, fiberglass, vinyl acrylic, and compositions all come in standard sizes, and many colors. They tend to be primary colors, and limited patterns are offered. When damaged panels must be replaced, dye lots and changing trends may limit the ability to obtain matching material. Carpet has found limited acceptance in this application, and is subject to similar problems if matching is needed. Wood is even less frequently used, except in areas where appearance is less important. Typically, wood is there to take the impact, and is expected to be less pleasing to the eye. Shaped coverings are used to either absorb an impact at a given height on the surface they cover, or to deflect the impact. Prior art in these applications includes, but is not limited to, bumper guards, crash rails, chair rails, handrails, and corner guards. Materials commonly used to create these shapes include, but are not limited to, metals, plastics, and wood. Some combine two or more of these materials. For example, prior art in bumper guards, crash rails, handrails, and corner guards combines a metal retainer with vinyl acrylic covers and end caps. On a well-designed application, these products, either alone or in combination, can be both protective to the surface behind, and pleasing to the eye.

In each of the foregoing prior art embodiments, some aspect of the stated criteria is not adequately addressed. For example, aesthetic features are quite limited on single component coverings. Additional design freedom can be achieved by combining two or more components. Prior art that has combined more than one component is limited. When custom features, such as logos or special graphics are achieved, they tend to be quite costly, and sometimes disappointing. Another example relates to how prior art embodiments meet the requirements of ADA law. Ramps and stairways, for example, are required to have tactile warning surfaces of specific design at each end. Prior art includes single component tiles designed to current standards. The standards are said to be likely to change (ADA documents on this item are currently being revised). A covering made from more than one material can meet current standards, while adding design features not possible in single component tiles. The component parts could also be easily altered to meet future code requirements.

Accordingly, it is desirable to provide a surface covering constructed of two or more components that can be easily and readily assembled with minimum time and labor. It is further desirable to provide a surface covering material that can easily and satisfactorily incorporate graphic designs, creating finished surfaces that are custom. It is also desirable to provide a surface covering that can be easily installed, even in situations where other covering cannot. Further, it is desirable to provide a surface covering that enhances safety by positively locking a textured, anti-slip material(s) over a surface that may otherwise become slippery when wet.

SUMMARY OF THE INVENTION

The present invention is an improved surface covering having a base that is constructed from a substantially rigid material. The base has first and second opposing sides. The first side of the base includes a plurality of working grooves and the second side of the base includes a plurality of receiving grooves. Each of the plurality of receiving grooves is a substantially linear groove having first and second opposing walls wherein the first and second opposing walls include a gripping projection. The improved surface covering of the subject invention further includes a plurality of filler strips positioned in respective ones of the plurality of receiving grooves in a manner such that the filler strips are gripped by the gripping projections of the first and second walls.

In an alternative embodiment of the invention, the base is constructed as described above with the exception that it is constructed from a substantially flexible material and is constructed without working grooves. The plurality of filler strips are positioned in the receiving grooves of the base as described above. In this embodiment, the improved surface covering further includes a base support that is constructed from a substantially rigid material. The base is fixed to the base support in a manner to prevent the base from flexing thereby to retain and grip the filler material in the receiving grooves of the base.

Another aspect of the subject invention is a method for constructing a surface material of the type having a substantially rigid base and a surface textured with a filler material. The method includes the steps of providing a base having receiving grooves in a first side and being constructed to be bent to vary the size of the receiving grooves. The method also includes the step of bending the base to expand the size of the receiving grooves so that the filler material may be inserted in the receiving grooves and inserting the filler material into the receiving grooves. Lastly, the method includes the step of returning the base to its original configuration so that the size of the receiving grooves is retracted and so that the receiving grooves grip the filler material to fix the position of the filler material.

In further detailed alternative embodiments of the above-described method, the step of providing a base having receiving grooves in a first side and being constructed to bend to vary the size of the receiving grooves includes the substep of providing working grooves on a second side of the base, opposite the first side, to permit the base to be bent. Alternatively, the step of providing a base having receiving grooves in a first side and being constructed to be bent to vary the size of the receiving grooves includes the substep of providing a flexible material having the receiving grooves positioned in a first side thereof. In the latter alternative embodiment, the method may include the still further step of fixing the flexible base material to a substantially rigid material after the filler material has been inserted to prevent the base from further flexing thereby to fix the position of the filler material.

DETAILED DESCRIPTION OF THE INVENTION

A surface covering 100 (FIG. 1) that is the subject of the present invention is constructed from first and second materials. A first material 102 is the base of the surface covering and a second material 104 is the filler material. The surface covering 100 is constructed from a series of planks 105 that are assembled together as discussed below. The surface covering 100 may be used to cover any structural surface, i.e., flat, sloped, or vertical surfaces. The planks 105 may be constructed of any width and length.

Figure 1:
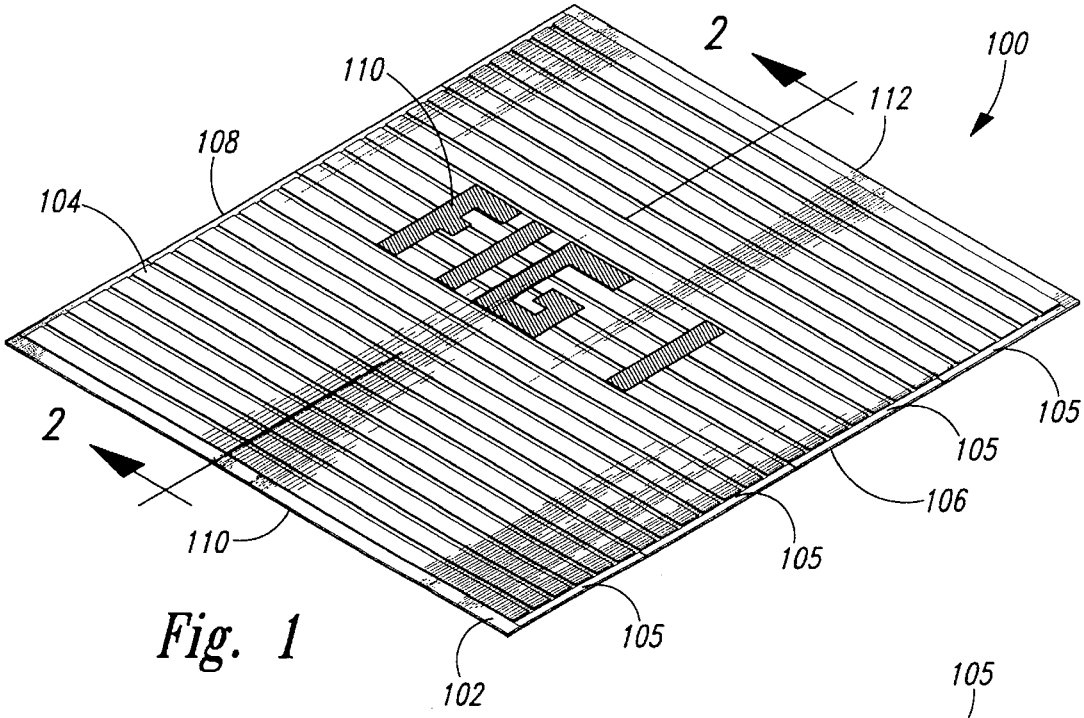
FIG. 1 is an illustration of the decorative surface covering that is the subject of the present invention.
Figure 2:
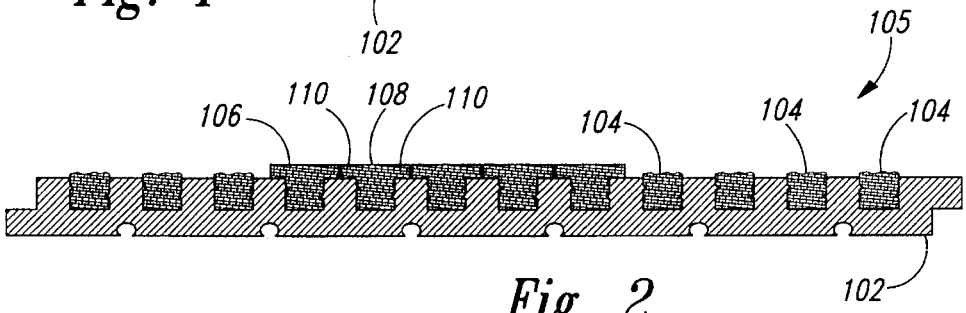
FIG. 2 is a cross-sectional view of the surface covering illustrated in FIG. 1.

Referring to FIG. 2, a cross-sectional view of a plank 105 of the surface covering 100, taken along lines 2—2, is illustrated. Therein, it can be seen that the base material 102 comprises a substantially unitary material that is filled with a plurality of portions 104 of the filler material. In reality, each filler material portion 104 shown in FIG. 2 extends the length of the mat as best illustrated in FIG. 1. The base material 102 is typically selected from a substantially rigid material that can be configured with receiving grooves (discussed below) and that can be arched for insertion of the filler material 102 As examples, the base material 102 may be metal, wood, tile, aluminum, etc., that may be extruded or machined in the configuration illustrated in FIG. 2.

Figure 3:
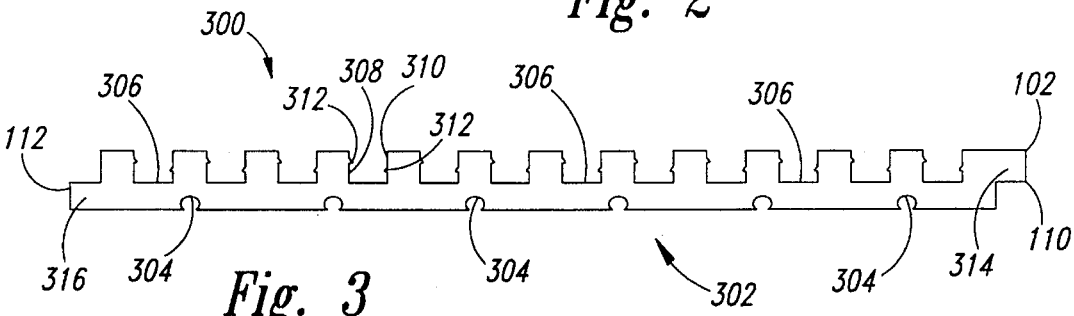
FIG. 3 is a cross-sectional illustration of the base material of the surface covering illustrated in FIG. 1.

Referring to FIG. 3, a more detailed description of the base material 102 is provided. The base material 102 comprises a substantially planar and substantially rigid material, as discussed above. The base material of each plank 105 includes first and second edges 106 and 108 (FIG. 1) as well as third and fourth edges 110 and 112, each being positioned in opposing relationship as illustrated. The base further includes a first side 302 and a second side 300. The first side of the base includes a plurality of working grooves 304 each of which extends from the first edge 106 to the second edge 108 as best illustrated in FIG. 1. The plurality of working grooves 304 are spaced along the first side of the base from the third edge 110 to the fourth edge 112. The second side of the base includes a plurality of receiving grooves 306 extending from the first edge 106 to the second edge 108 of the base 102. The plurality of receiving grooves 306 are spaced along the first side of the base from the third edge 100 to the fourth edge 112. Each of the plurality of receiving grooves is a substantially linear groove having first and second opposing walls 308 and 310. Each first and second wall 308 and 310 includes a gripping projection 312.

Figure 4:
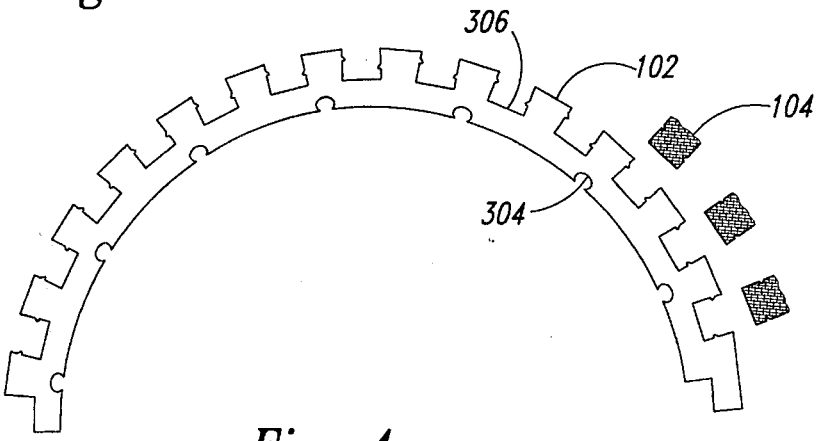
FIG. 4 is an illustration of the manner in which the base material is flexed to permit insertion of the filler material.

The receiving grooves 312 are provided for receiving the filler material 104. To accomplish this result, the working grooves 304 are provided for permitting the plank 105 to be bent thereby to expand the dimension of the receiving grooves 306, as illustrated in FIG. 4. When the base material is bent, the receiving grooves open to allow the tiller material to be easily inserted. After insertion of the filler material, the base material is returned to its original planar configuration so that the receiving grooves retract in size thereby clamping on the filler material and gripping the filler material with the gripping projections 312.

Advantageously, various materials can be used for the filler material 104. In fact, using the improved method of the subject invention, it is possible to provide different filler materials in a single receiving groove 306 so that the combination of adjacent receiving grooves 306 will provide a design-like appearance, e.g., logo designs, numbers, lettering, etc., similar to that illustrated in FIG. 1. As examples, the filler material 104 could be made of metal, plastic, composite material, rubber, etc. It should be noted that it may be desirable to reconstruct the shape of the receiving grooves 306 and/or the gripping projections 312 when using differing filler materials.

Referring to FIG. 2, an alternative filler material 106 is there indicated. The alternative filler material is constructed to fit within the receiving grooves 306 and the filler material 104. However, the alternative filler material 106 further includes a top portion 108 having extending flanges 110. The extending flanges 110 can be made of any length desirable. In the embodiment illustrated in FIG. 3, the extending flanges 110 are constructed to extend substantially half way intermediate receiving grooves so that adjacent extending flanges abut one another. FIG. 1 illustrates how the alternative filler material 110 combines with the filler material 106 to provide an overall decorative appearance to the surface covering 100.

Advantageously, the planks 105 may each include first and second mating flanges 314 and 316 (FIG. 3) so that the surface covering can be made in planks and laid with the flanges 314 of a first plank 105 mating with the flanges 316 of the adjacent plank 105.

Still further, those skilled in the art will appreciate that the working grooves 304 provide a dual purpose. In addition to permitting the base material 102 to be flexed, thereby permitting insertion of the filler material 104, the working grooves 304 also provide added gripping for adhesive used to bond the planks 105 of the surface covering 100 to the surface to be covered. The adhesively bound working groove also serves to exclude water from entering between the cover and the surface.

Figure 5:
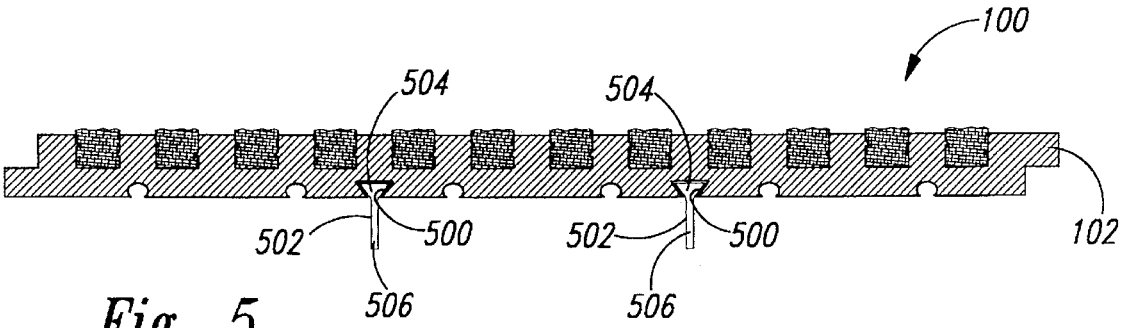
FIG. 5 is a cross sectional view of an alternative embodiment of the present invention illustrating fasteners in combination with the improved surface covering.

In an alternative embodiment of the invention illustrated in FIG. 5, the base material 102 includes a plurality of receiving slots 500 each constructed for receiving a fastener 502. The fasteners 502 are of the type that include a head portion 504 and a stem 506. The head portion of the fastener is constructed to be positioned in the receiving slot so that the fastener is slidably retained therein and so that the stem portion 506 extends outward from the base 102. The fastener can then be used to fasten the surface covering to a surface.

The plurality of receiving slots 500 in the bottom of the base material 102 allow the fastener 502 to slide into desired locations along the base material 102. In one presently envisioned embodiment of the invention, the fasteners 502 may be provided with magnetic properties that allow the fasteners to be detected using a stud finder. The fasteners 502 are designed to mate with an epoxy-filled device that is inserted into drilled holes in the surface to be covered.

Since the heads of the fasteners are concealed from view, and the stem becomes permanently inserted in the insert, removal must be by drilling through the covering material and removing the head of the fastener with a drill. Magnetized fasteners may be readily located with a stud finder, or similar device, so that the head can be drilled. Once the fastener heads are drilled off, the plank can be pried up. By using a combination of adhesive sealant and mechanical fasteners, the permanence of the installation is assured under even heavy abuse.

Figure 6:
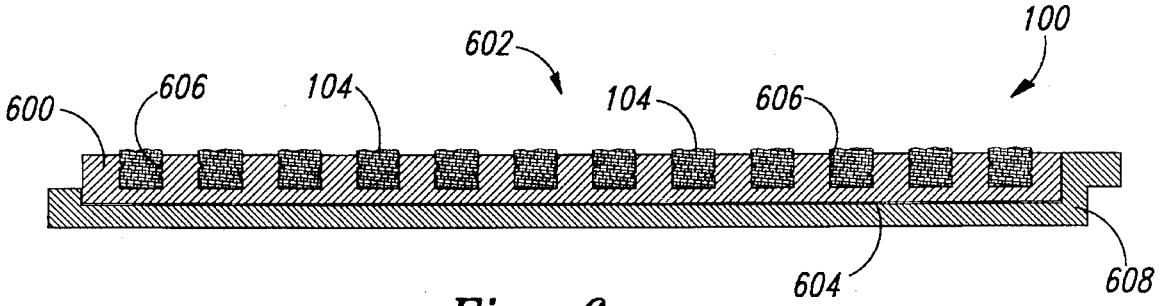
FIG. 6 is a further alternative embodiment of the improved surface covering of the subject invention.

Still another alternative embodiment of the invention is illustrated in FIG. 6. Therein, the surface covering 100 includes a flexible carrier 600 wherein the carrier 600 is constructed from a substantially flexible material. The carrier has first and second opposing sides 602 and 604 wherein the first side of the carrier includes a plurality of receiving grooves 606. Each of the plurality of receiving grooves comprising a substantially linear groove having first and second opposing walls wherein said first and second opposing walls include gripping projections as described above by reference to the embodiments of FIGS. 2–4.

In the embodiment of FIG. 6, the flexible carrier 600 is constructed to be bent to receive a filler material 104 in the same manner that the base was bent to receive the filler material in the embodiments described by reference to FIGS. 2–4. However, in the embodiment illustrated in FIG. 6, the flexible carrier is further constructed to be mated with a substantially rigid base support 608 after receiving the tiller material 104. The base support 608 provides a rigid structure for the surface covering in addition to preventing the flexible material from flexing. Accordingly, the flexible material 600 retains the filler material 104 in position in the same manner as described above by reference to the embodiments of FIGS. 2–4.

Figure 7:
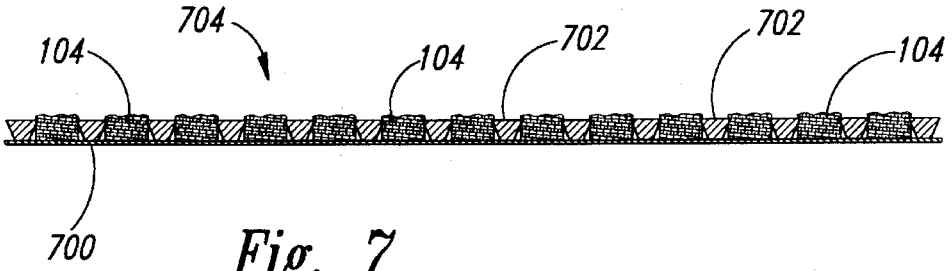
FIG. 7 is another alternative embodiment of the improved surface covering of the subject invention.

In still another alternative embodiment of the invention, the base material comprises a thin sheet of metal 700 to which is mechanically adhered a plurality of rigid bars 702. The rigid bars 702 are constructed in a form so that adjacent ones of the rigid bars 702 create receiving grooves 704 into which the filler material 104 is inserted. For installation, the surface covering of FIG. 7 may be flexed as described above by reference to FIGS. 2–4. Various materials can be used for either the base material, rigid strips or filler material, all as discussed above.

From the foregoing, it will be appreciated that, although specific embodiments of the invention have been described herein for purposes of illustration, various modifications may be made without deviating from the spirit and scope of the invention. Accordingly, the invention is not limited except as by the appended claims.

I claim:

1. A surface covering comprising:

a base constructed from a substantially planar and rigid material, said base having first, second, third, and fourth edges and first and second opposing sides, said first and second edges being positioned in opposing relationship and said third and fourth edges being positioned in opposing relationship, said first side of said base including a plurality of working grooves extending from said first edge to said second edge of said base, said plurality of working grooves being spaced apart from one another along said first side of said base from said third edge to said fourth edge, said second side of said base including a plurality of receiving grooves extending from said first edge to said second edge of said base, said plurality of receiving grooves being spaced apart from one another along said second side of said base from said third edge to said fourth edge, each of said plurality of receiving grooves being a substantially linear groove having first and second opposing walls extending from said first edge to said second edge, each said first and second wall having a gripping projection projecting into said corresponding receiving groove and extending from said first edge to said second edge, said first side of said base including a plurality of receiving slots;

a plurality of fasteners each having a head portion and a stem portion, said plurality of fasteners being positioned in said plurality of receiving slots so that said head portion is movably secured within said slot and so that said stem portion extends outward from said slot; and a plurality of filler strips each being a substantially compliant material positioned in respective ones of said plurality of receiving grooves and being gripped by said gripping projections of said first and second walls of said receiving grooves, each of said plurality of filler strips extending outward from said receiving grooves to provide a textured surface for said surface covering.

2. The surface covering as recited in claim 1 wherein said filler strips further comprise first and second filler strips constructed from first and second substantially compliant material and wherein a portion of said receiving grooves having said first and second filler strips positioned therein.

3. A surface covering comprising:

a base constructed from a rigid material, said base having first and second opposing sides, said first side of said base including a plurality of spaced apart working grooves and said second side of said base including a plurality of spaced apart receiving grooves, each of said plurality of receiving grooves being a substantially linear groove having first and second opposing walls wherein said first and second opposing walls include a gripping projection projecting into said corresponding receiving groove; and a plurality of filler strips positioned in respective ones of said plurality of receiving grooves and being gripped by said gripping projections of said first and second walls.

4. The surface covering as recited in claim 3 wherein said plurality of filler strips further comprise members that extend outward of said receiving grooves to provide a textured surface for the surface covering.

5. The surface covering as recited in claim 3 wherein said filler strips further comprise first and second filler strips wherein a portion of said receiving grooves have said first and second filler strips positioned therein.

6. The surface covering as recited in claim 3 wherein said base includes first and second edges positioned at opposing ends of said base and wherein said working grooves and said receiving grooves extend from said first edge to said second edge.

7. The surface covering as recited in claim 3 wherein said first side of said base further comprises a plurality of receiving slots and a plurality of fasteners wherein said plurality of fasteners each includes a head portion and a stem portion, said head portions of said plurality of fasteners being slidably received in said plurality of receiving slots so that said stem portions of said plurality of fasteners extend outward from said base.

8. A surface covering comprising:

a base constructed from a substantially flexible material, said base having first and second opposing sides, said first side of said base including a plurality of spaced apart receiving grooves wherein each of said plurality of receiving grooves is a substantially linear groove having first and second opposing walls wherein said first and second opposing walls include a gripping projection projecting into said corresponding receiving grooves;

a plurality of filler strips positioned in respective ones of said plurality of receiving grooves and being gripped by said gripping projections of said first and second walls; and a base support constructed from a rigid material, said base being fixed to said base support in a manner to prevent said base from flexing thereby to retain and grip said filler material in said receiving grooves of said base.

9. The surface covering as recited in claim 8 wherein said plurality of filler strips further comprise members that extend outward of said receiving grooves to provide a textured surface for the surface covering.

10. The surface covering as recited in claim 8 wherein said filler strips further comprise first and second filler strips wherein a portion of said receiving grooves have said first and second filler strips positioned therein.

11. A surface covering comprising:

plurality of filler means for providing a textured surface to said surface covering; and base means having a plurality of spaced apart receiving grooves and gripping means for receiving and gripping said filler means to fix the position of said filler means with respect to said base means, said base means including bending means for varying the size of said receiving grooves so that the size of said receiving grooves can be expanded when receiving said filler means and so that the size of said receiving grooves can be retracted to grip said filler means, wherein said plurality of filler means are positioned in said plurality of spaced apart receiving grooves.

12. The surface covering as recited in claim 11 wherein said bending means comprises a plurality of spaced apart working grooves that permit said base means to be bent thereby to expand the size of said receiving grooves to receive said filler means and which permit said base means to be returned to its original configuration thereby to retract the size of said receiving grooves to grip said filler means.

13. The surface covering as recited in claim 11 wherein said bending means comprises a flexible material.

14. The surface covering as recited in claim 11 wherein said base means comprises a flexible material having said receiving grooves in a first side thereof fixed to a rigid material.

15. The surface covering as recited in claim 11, further comprising fastening means for fastening the surface material to a surface.

16. A surface covering comprising:

a plurality of filler means for providing a textured surface to said surface covering; and base means having a plurality of spaced apart working grooves for permitting said base means to be bent, said base means including a plurality of spaced apart receiving grooves and gripping means projecting into said receiving grooves for receiving and gripping said filler means to fix the position of said filler means with respect to said base means, said gripping means being responsive to bending of said base means for receiving said filler means and being responsive to said base means being returned to its original configuration for gripping said filler means, wherein said plurality of filler means are positioned in said plurality of said receiving grooves.

17. The surface covering as recited in claim 16 wherein said base means comprises a flexible material capable of being bent for gripping said filler material, said flexible material being fixed to a rigid material.

18. The surface covering as recited in claim 16, further comprising fastening means for fastening the surface material to a surface.

* * * * *